US010381144B1

(12) United States Patent
Degner

(10) Patent No.: US 10,381,144 B1
(45) Date of Patent: Aug. 13, 2019

(54) HAPTIC ACTUATOR WITH FERRITIC CORE

(71) Applicant: Apple Inc., Cupertino, CA (US)

(72) Inventor: Brett W. Degner, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/343,177

(22) Filed: Nov. 3, 2016

Related U.S. Application Data

(60) Provisional application No. 62/397,649, filed on Sep. 21, 2016.

(51) Int. Cl.
*H01F 7/00* (2006.01)
*H01F 7/10* (2006.01)

(52) U.S. Cl.
CPC ..... *H01F 7/10* (2013.01)

(58) Field of Classification Search
CPC ..... H02K 33/16
USPC ..... 335/69, 87, 235
See application file for complete search history.

(56) References Cited

U.S. PATENT DOCUMENTS 5,065,126 A * 11/1991 Suzuki ..... H01F 7/066 335/222
5,808,381 A * 9/1998 Aoyama ..... H02K 41/03 310/12.22
5,896,076 A * 4/1999 van Namen ..... H01F 7/1615 335/222
6,163,091 A * 12/2000 Wasson ..... H02K 41/03 310/12.19
6,664,664 B2 * 12/2003 Botos ..... H02K 41/03 310/12.22
8,421,564 B2 * 4/2013 Yajima ..... H01F 7/1646 310/12.25
8,665,042 B2 * 3/2014 Takahashi ..... H02K 35/02 335/207
8,682,396 B2 * 3/2014 Yang ..... B06B 1/045 310/12.04
8,829,741 B2 * 9/2014 Park ..... B06B 1/045 310/25
2004/0155741 A1 * 8/2004 Godin ..... H01F 7/066 335/220
2005/0046282 A1 * 3/2005 Tang ..... H02K 1/34 310/12.02
2008/0069554 A1 * 3/2008 Huang ..... G03B 3/10 396/133

(Continued)

*Primary Examiner* — Alexander Talpalatski
(74) *Attorney, Agent, or Firm* — Brownstein Hyatt Farber Schreck, LLP

(57) ABSTRACT

Disclosed herein are linear actuators and haptic actuators for providing haptic output on an electronic device. In some embodiments, the linear actuator comprises two linear arrays of permanent magnets within and fixed to a housing. The linear arrays are arranged in parallel planes oriented toward, and located on opposites sides of, a moveable assembly comprising a shaft having a ferritic core. The shaft comprises a set of conducting coils, each conducting coil being located between a magnet from each of the two linear arrays. The linear actuator comprises a support mechanism that is attached to both the housing and to the moveable assembly and is configured to pivot. An electromagnetic force can arise from a current in the coils to cause the moveable assembly to move linearly between the two linear arrays.

20 Claims, 15 Drawing Sheets

(56) References Cited

U.S. PATENT DOCUMENTS

| | | | | |
|---|---|---|---|---|
| 2008/0164963 | A1* | 7/2008 | Tominaga | H02K 41/0356<br>335/222 |
| 2011/0169347 | A1* | 7/2011 | Miyamoto | B06B 1/045<br>310/12.21 |
| 2012/0153748 | A1* | 6/2012 | Wauke | H02K 33/16<br>310/25 |

* cited by examiner

HAPTIC ACTUATOR WITH FERRITIC CORE

CROSS-REFERENCE TO RELATED APPLICATION(S)

This application is a nonprovisional patent application of and claims the benefit of U.S. Provisional Patent Application No. 62/397,649, filed Sep. 21, 2016 and titled "Haptic Actuator with Ferritic Core," the disclosure of which is hereby incorporated herein by reference in its entirety.

FIELD

The present disclosure generally relates to linear actuators that can be used to provide haptic output for an electronic device. More specifically, the present disclosure is directed to a bidirectional linear actuator having a coil architecture on a ferritic shaft and stationary magnet arrays that can provide haptic output for an electronic device in response to an electromagnetic force.

BACKGROUND

Electronic devices are commonplace in today's society. Example electronic devices include cell phones, tablet computers, personal digital assistants, and the like. Some of these electronic devices include a haptic actuator that provides haptic (touch) output to a user. The haptic output may be provided by an actuator that utilizes a vibratory motor or an oscillating motor. The vibration may alert a user to an incoming telephone call when the cell phone is muted, for example. The vibration takes the place of the standard audio alert and may be felt by the user if he or she is touching the phone. However, the vibration may still be noisy in certain environments and this may be undesirable.

Further, many rotary mass actuators not only create an audible buzz, but also an undesirable feel. Because rotary mass actuators spin up to an operating state and then wind down to a rest state, they constantly shake the enclosure of the electronic device. This feels "buzzy" to a user and there is little, if any, control over the haptic output of such a device other than to control the amplitude of the output or to provide discrete outputs with an unacceptably long time between the outputs.

Certain linear actuators are used instead of rotary mass actuators in some electronic devices. Linear actuators may deliver a more crisp haptic output and are quieter in certain cases. However, many such linear actuators are relatively large and some may move a mass only in a single direction. Accordingly, an improved linear actuator, such as one with a narrow profile, may be advantageous.

SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter.

Disclosed herein are linear actuators, haptic actuators, and devices for providing haptic output or other tactile sensations for an electronic device. The haptic devices may make use of a linear actuator s that causes bidirectional linear motion of a moveable assembly by applying electromagnetic force. The haptic devices are connected to the electronic device through attachment components so that the bidirectional linear motion of the linear actuator is a transmitted to the electronic device. In some embodiments, arrays of magnets that are fixed to a housing of the linear actuator are configured on opposite sides of a shaft, and a sequence of conducting coils is wound around the shaft. Current in the conducting coils induces electromagnetic forces on the shaft, causing it to move linearly.

More specifically, an embodiment described herein is a linear actuator having a housing that includes a ferritic material. Within and fixed to the housing are a first set of permanent magnets that form a first linear array and a second set of permanent magnets that form a second linear array. The linear actuator further includes a moveable assembly having a shaft positioned between the first and second linear arrays of magnets. Wound around the shaft is a set of conducting coils, with each conducting coil located between a permanent magnet of the first linear array and a permanent magnet of the second linear array. The moveable assembly is attached to a support mechanism that is attached to the housing. The support mechanism is configured to pivot as the moveable assembly moves linearly along an axis of the housing.

In additional or alternative embodiments, the magnets have a flat shape having two faces, with the faces being the magnetic poles of the magnet and so of opposite polarity. A first face is attached to the housing to channel the magnet's magnetic flux into the housing. The second face is oriented directly toward a conducting coil on the shaft. The shaft can have a wide thin cross section with respect to an axis of a long dimension of the shaft. The axis of the shaft is configured to be parallel to an axis of the housing. Magnetic fields from the second faces of the magnets are thus perpendicular to the axis of the shaft and so also of the axis of the conducting coils.

As current is induced in the conducting coils, Lorenz forces arise from the vector cross products of the current directions with the magnetic fields from the two faces of the permanent magnets. These Lorenz forces are applied to the shaft and directed along the axis of the shaft. The Lorenz forces may cause the moveable assembly to move linearly along the direction of the shaft. Applying alternating current causes the moveable assembly to alternate directions of movement. The support mechanism can support the moveable assembly so that it does not contact the magnets. As the direction of movement of the moveable assembly alternates, a change in momentum is transferred to the housing, causing a haptic output.

Also described is an electronic device that includes a haptic actuator. The haptic actuator provides a vibratory tactile output from the electronic device. The haptic actuator uses a linear actuator contained within an interior volume of a housing. Electromagnetic forces are applied by the linear actuator to induce linear motion in a moveable assembly in the interior volume. The moveable assembly is attached to a support mechanism within the interior volume that can pivot as the moveable assembly moves linearly. The support mechanism is fixed to the housing so that motion of the moveable assembly is transferred through the housing to electronic device.

More specifically, an embodiment described herein is haptic actuator for an electronic device that is operative to provide haptic output to electronic device in response to an input received from the electronic device. The haptic actuator includes a linear actuator, a housing that encloses an interior volume and that has exterior attachment components by which it can be attached to the electronic device. A set of magnets is positioned in the interior volume to form a linear array; the magnets are fixed to one or more internal surfaces of the housing. The linear actuator also includes a moveable assembly that in turn includes a shaft positioned adjacent to the linear array of magnets. Wound around the shaft is a set of conducting coils, with each conducting coil positioned adjacent to a respective magnet of the linear array of magnets. The linear actuator also includes a support mechanism within the interior volume that is attached to the housing and to the moveable assembly. The support mechanism is operative to pivot. A received input from the electronic device causes a current to flow in at least one conducting coil. The flowing current generates an electromagnetic force that is applied to the shaft along an axis of the shaft and so causes the moveable assembly to move linearly in the direction of the axis of the shaft as the support mechanism pivots.

In additional or alternative embodiments the linear array of magnets have magnetic pole faces directed toward the conducting coils, with the magnetic polarity of the magnetic pole faces alternating sequentially along the linear array.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1A:
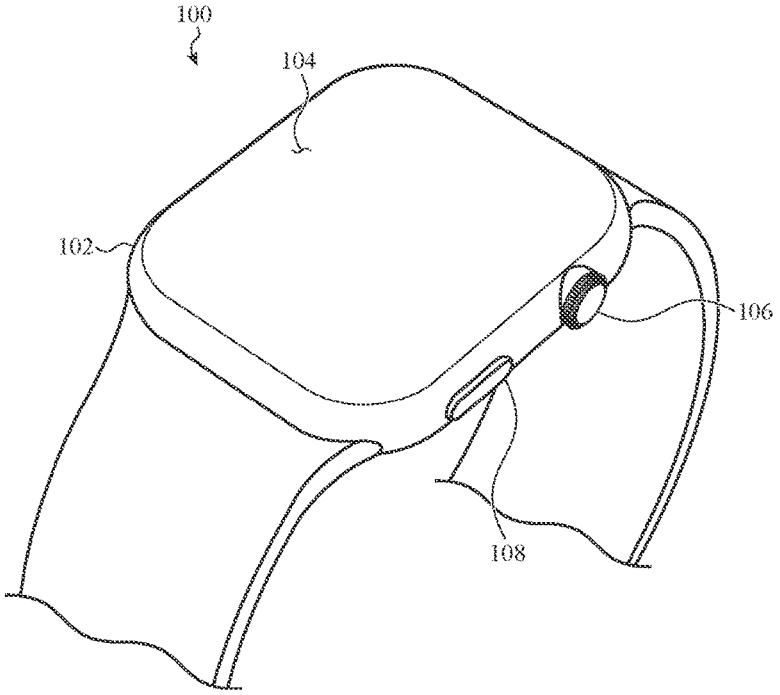
FIG. 1A illustrates a first electronic device that may incorporate an embodiment.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The embodiments disclosed herein are directed to haptic actuators for use as part of an electronic device. It is sometimes desired for an electronic device to transmit a signal to a user in the form of a haptic output, i.e., a tactile output. Examples include a smart watch that vibrates at a scheduled time, and a cell phone that vibrates for an incoming call.

Haptic actuators often include a support mechanism for attachment to an electronic device and a linear actuator that moves a mass in varying directions; changes in momentum of the mass are transmitted through the support mechanism to the electronic device. In particular, linear actuators work by moving a mass in one or both directions along a single line or axis. Embodiments disclosed herein are directed to linear haptic actuators for electronic devices.

Although specific electronic devices are shown in the figures and described below, the haptic actuators described herein may be used with various electronic devices, mechanical devices, electromechanical devices and so on. Examples of such include, but are not limited to, mobile phones, personal digital assistants, time keeping devices, health monitoring devices, wearable electronic devices, input devices (e.g., a stylus, trackpads, buttons, switches, and so on), a desktop computer, electronic glasses, steering wheels, dashboards, bands for a wearable electronic devices, and so on. Although various electronic devices are mentioned, the haptic actuators and linear actuators disclosed herein may also be used in conjunction with other products and combined with various materials.

The linear actuators described herein operate to produce haptic output by moving a mass bilinearly, that is, in both directions along a single line. For brevity of this disclosure such bilinear motion will simply be termed "linear motion" and objects exhibiting such bilinear motion will be said to be moving "linearly." By conservation of momentum, changes in the direction of motion of the mass are transferred to support mechanisms of the mass. When the support mechanisms are connected to an electronic device, either directly or through intermediate components such as a housing for the actuator, the changed momentum of the mass is transferred to the electronic device and so produces a haptic output.

Some forms of linear actuators are configured to have one or more current carrying coils of wires that are stationary within a housing. In those forms, a movable mass then may include one or more magnets, either permanent magnets or electromagnets. Alternating current induced in the current carrying coils generates magnetic fields that in turn exert electromagnetic forces on the magnets of the movable mass. As used herein, an "electromagnetic force" denotes an electric force, a magnetic force, or a combination thereof.

In contrast, some linear actuators described herein make use stationary magnets attached to a housing of the linear actuator. In some embodiments a moveable assembly within the housing has a shaft about which conducting coils are wound. Currents induced in the conducting coils are subject to a Lorentz force that can cause the moveable assembly to move. Some embodiments include permanent magnets in planar arrays and have a shaft with a wide, thin cross section so that the wires in the conducting coils about the shaft form, in cross section, two approximately parallel lines, with comparatively small perpendicular connections. This is termed a "flat coil architecture." This can allow for a slimmer and smaller profile for the haptic actuator.

Further, magnetic fields from the stationary magnets can be oriented to pass into a housing made of a ferritic material. Typically, but not necessarily, a ferritic material has a high magnetic permeability. When the stationary magnets are arranged in a linear array and adjacent magnets of the array have alternating polarities, the magnetic flux from the permanent magnets may be mostly confined to the housing and so shield components outside the haptic actuator from magnetic fields. Further, a ferritic housing can shield the internal components of the haptic actuator from electromagnetic fields originating outside the haptic actuator.

When the shaft is made, at least in part, of a ferritic material, the magnetic fields produced by the magnets can then be channeled into the shaft and so reduce fringing effects of the magnetic fields. This can increase the strength of the magnetic fields that contribute to the Lorentz force, and so produce a stronger haptic output from less current.

Detailed embodiments of these general considerations will now be disclosed in relation to the accompanying figures.

FIG. 1A illustrates a first example electronic device 100 that may incorporate a haptic actuator according to one or more embodiments presented herein. In the example shown, the electronic device is an electronic watch 100. The haptic actuator may be mounted internally to provide a haptic output through either a case 102 or a surface 104 of the electronic watch 100. The electronic watch 100 may include a stem input 106 and a button 108 by which a user may control operations of the electronic watch, including behaviors of the haptic actuator. As the electronic watch 100 is relatively small, the associated haptic actuator may be similarly compact.

Figure 1B:
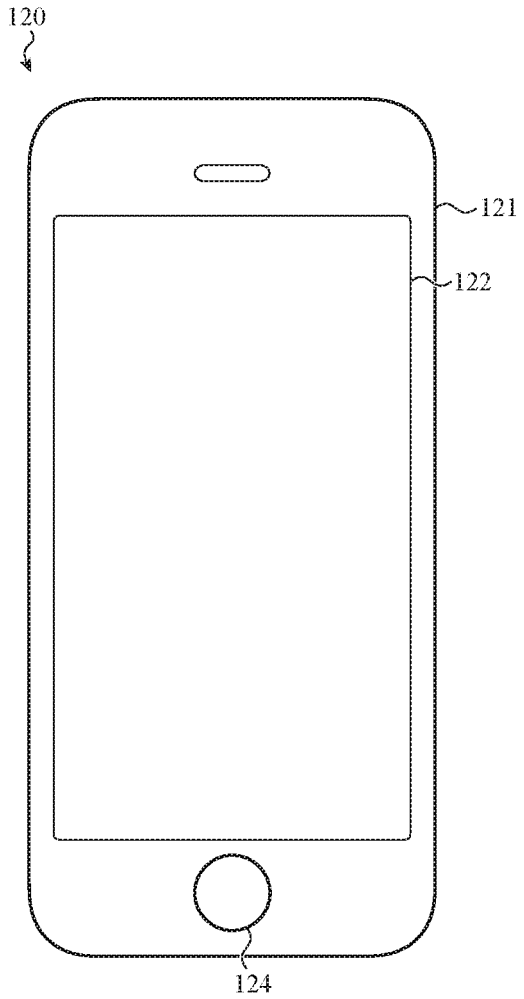
FIG. 1B illustrates second electronic device that may incorporate an embodiment.

FIG. 1B illustrates a second electronic device 120 that may incorporate a haptic actuator according to one or more embodiments of the presented herein. In this example the electronic device is a smart phone having a case 121, a surface display 122, and an user input button 124. The smart phone 120 may have a program that, when run, allows a user to modify the behavior of the haptic actuator.

Haptic actuators that use one of the linear actuators described herein may replace rotary or conventional linear actuators in the electronic devices described above. As a result, the profile of the electronic devices may be smaller or thinner.

Figure 2A:
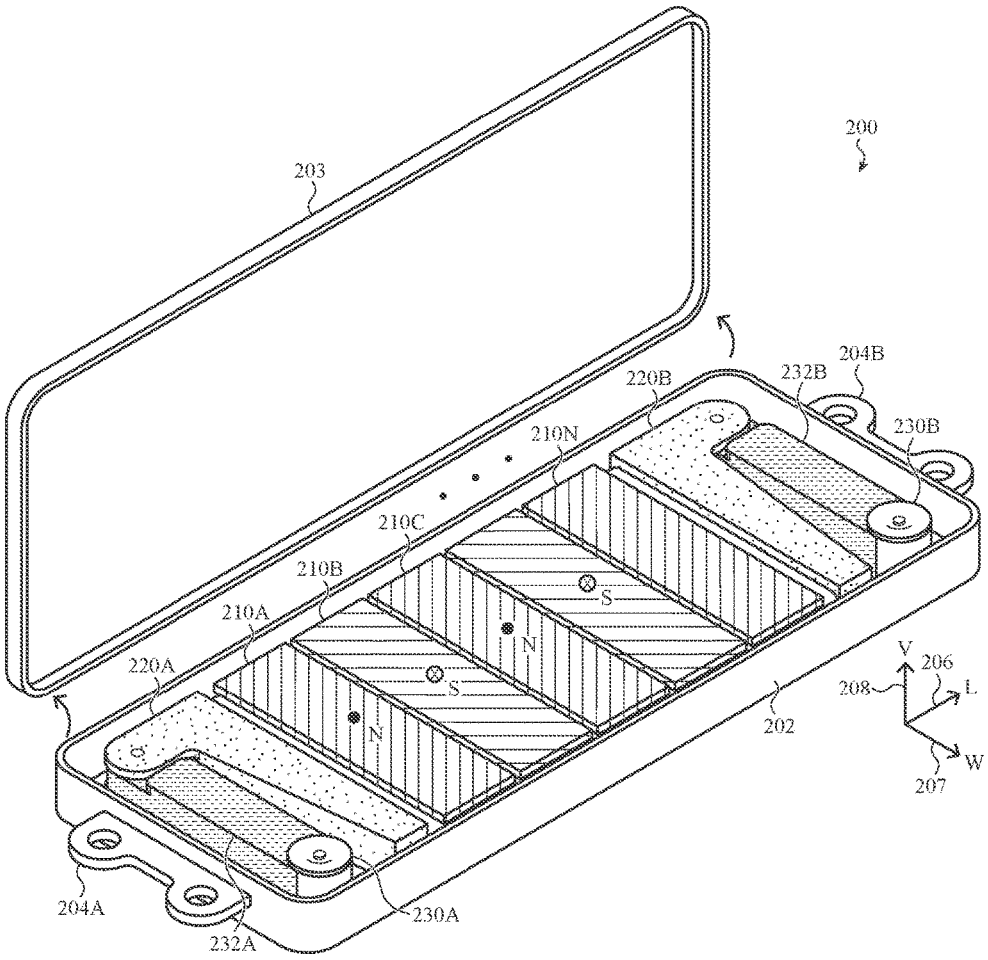
FIG. 2A illustrates a haptic actuator, according to an embodiment.

FIG. 2A illustrates components of an embodiment of a haptic actuator 200 that may be used to provided haptic output in an electronic device. The haptic actuator 200 comprises a connection mechanism to link it to electronic device, a housing and a linear actuator within the housing. The linear actuator for the haptic actuator 200 is shown within an interior volume formed by a first housing component 202 and a top component 203; the top component 203 is detached in FIG. 2A to show internal components within the interior volume. The first housing component 202, together with the top component 203, is referred to collectively as the "housing." The first housing component 202 and top component 203 may be made from a ferritic material, (e.g., a cobalt-iron soft magnetic alloy such as Hiperco27, Hiperco 50 or others), to provide magnetic shielding of components within the interior volume of the housing from outside electromagnetic forces, and to provide a channel for magnet flux from magnets within the interior volume, as described below.

The first housing component 202 includes attachment tabs 204A and 204B. These tabs may secure the haptic actuator 200 to an electronic device (or other structure) so that linear movements of the linear actuator are transmitted to the electronic device. Other embodiments may have alternative attachment components by which the haptic actuator can be attached to an electronic device.

The embodiment shown in FIG. 2A has a longest dimension, L, indicated by the axis 206. Also, this embodiment has a second longest dimension, W, shown by axis 207, that is perpendicular axis 206. Finally, this embodiment has a smallest dimension, V, indicated by axis 208, that is perpendicular to both axes 206 and 207.

Pivots 230A, 230B are affixed to interior surfaces of the housing but are free to rotate about respective axes. In the embodiment shown, the pivots 230A, 230B are at opposing ends of the longest axis 206 of the linear actuator. Respective pivot arms 232A, 232B are attached to the pivots 230A, 230B. These pivot arms are configured to rotate in both directions within the interior of the linear actuator about respective axes of the pivots 230A, 230B. Pivot 230A and pivot arm 232A may be formed as a single component. In some embodiments pivots 230A, 230B may include internal restoring springs that counteract rotations of pivot arms 232A, 232B from a neutral or equilibrium angle.

External ends 220A, 220B are flexibly coupled to respective pivot arms 232A, 232B. The external ends 220A, 220B are at opposing ends of a shaft (not shown in FIG. 2A, but shown and discussed below with respect to FIG. 3). The external ends 220A, 220B of the shaft may be composed of a non-ferritic metal, such as tungsten, to provide increased mass to be moved by the linear actuator to provide increased haptic output. In alternative embodiments, one or more of the external ends may include ferritic material. As pivot arm 232A rotates about pivot 230A, its flexible coupling with external end 220A allows external end 220A to move primarily linearly along the axis 206 of the housing. Further details of the configuration and motions of the external ends 220A, 220B, the pivots 230A, 230B, and the pivot arms 232A and 232B, will be provided below in relation to FIGS. 3A-C.

A first linear array of magnets 210A-N is configured sequentially within the interior volume of the haptic actuator 200 along the axis 206. In the embodiment shown, the magnets have longest dimensions that are oriented across the horizontal axis 207 of the housing. The particular embodiment shown uses five planar magnets (i.e., N=5), though other embodiments may use either more or fewer magnets. The planar magnets are oriented to lie in a plane parallel to the plane defined by axes 206 and 207. Each of the magnets 210A-N in the first linear array has one of its magnetic pole faces oriented along the axis 208 of the linear actuator. In the embodiment shown, when the top component 203 is attached to the first housing component 202, the magnetic poles of the magnets 210A-N are directed perpendicular into the top component 203. The magnetic poles of the magnets 210A-N alternate sequentially along the first linear array, as will be explained further below.

Figure 2B:
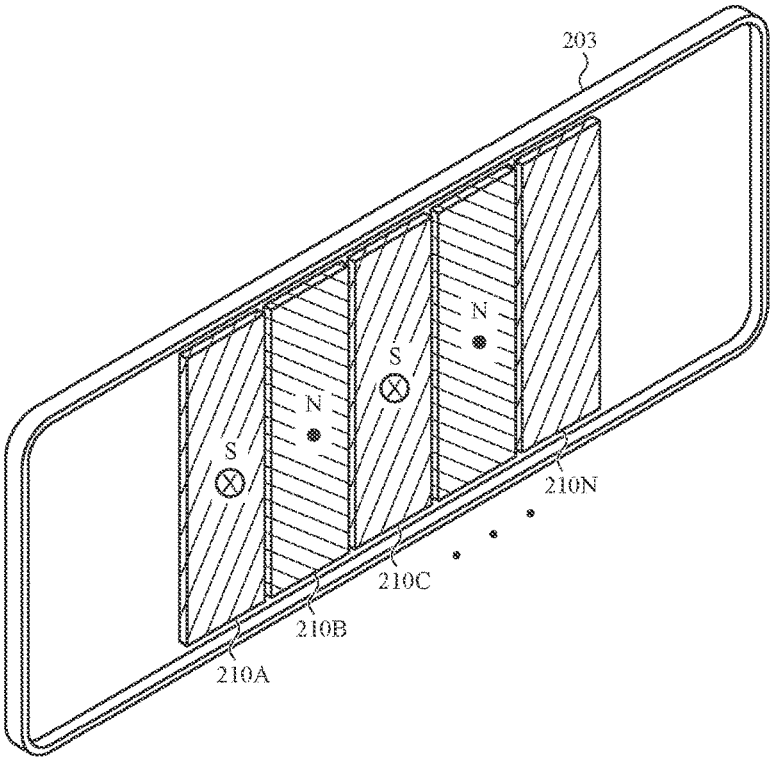
FIG. 2B illustrates a configuration of a first array of magnets on a first housing component of a haptic actuator, according to an embodiment.

In some embodiments, the first linear array of magnets 210A-N is fixed in position with respect to the housing. In one embodiment the magnets 210A-N are attached at their horizontal edges to the first housing component 202. In an alternative embodiment, shown in FIG. 2B, the planar magnetic pole faces of the magnets 210A-N are attached directly to, and are flush with, the top component 203 of the housing. Note that in FIG. 2B the shown magnetic pole faces are on the opposite sides of the planar magnets 210A-N as shown in FIG. 2A, and so have opposite magnetic polarity. The magnets 210A-N may be made with a material of high magnetic strength, e.g., N48H, another neodymium-iron-boron alloy or other magnetic material.

Figure 2C:
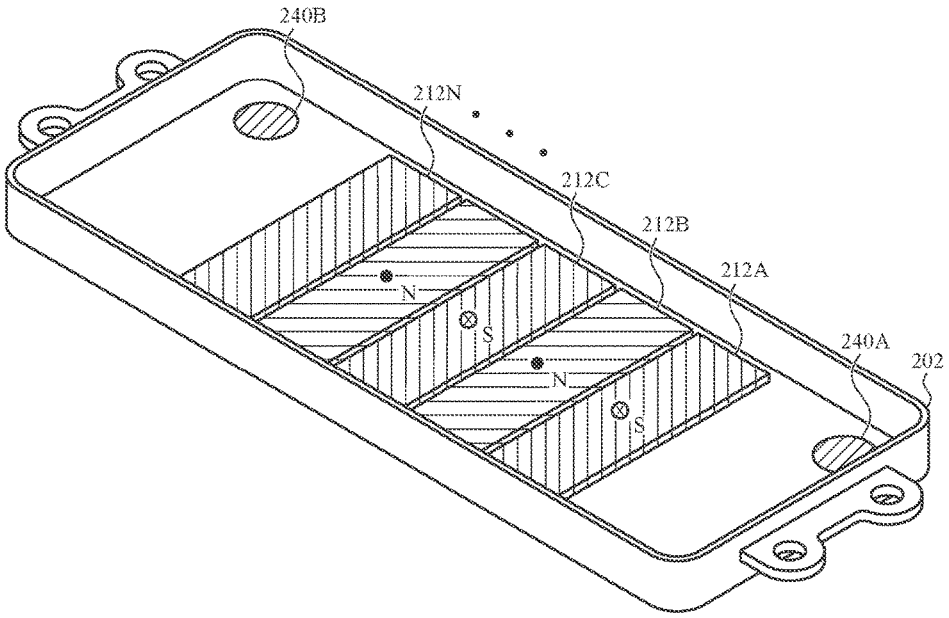
FIG. 2C illustrates a configuration of a second array of magnets on a second housing component of a haptic actuator, according to an embodiment.

FIG. 2C illustrates a configuration for a second linear array of magnets, 212A-N, with N=5 as for the first linear array. In the embodiment shown, the magnets of the second linear array are also planar magnets, and are affixed sequentially to an interior surface of the first housing component 202. The shown magnetic pole faces of the magnets in the second linear array are directed perpendicular to the surface of the housing component 202 into the interior volume. In the embodiment shown, when the top component of the housing 203 is attached the first component of the housing 202, each magnet of the first linear array is directly opposite a respective magnet of the second linear array to form a sequence of magnet pairs. Further, the magnetic pole faces of the two magnets in each such magnet pair have the same magnetic polarity. That is, either both have "North" (N) magnetic polarity, or both have "South" magnetic polarity (S). The magnetic pole faces of the magnets in the second linear array also have sequentially alternating magnetic polarity. FIG. 2C also shows attachment sites 240A, 240B at which pivots 230A, 230B may be affixed to the housing.

While in the embodiments shown and discussed the magnets 210A-N and 212A-N are permanent magnets, in some embodiments the magnets 210A-N and 212A-N may be implemented as electromagnets.

Figure 3A:
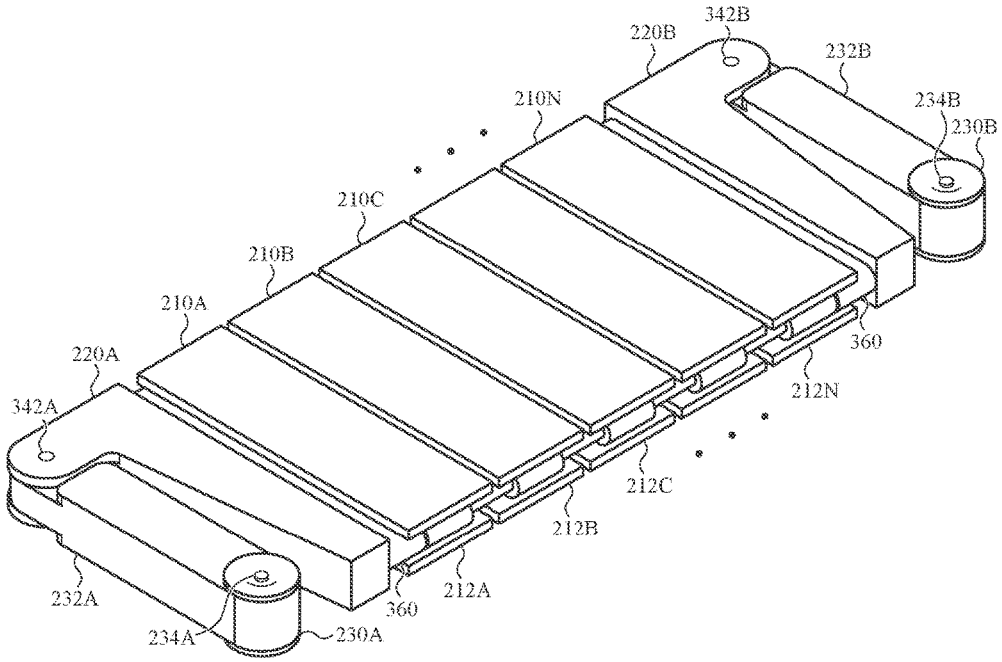
FIG. 3A illustrates certain internal components of a haptic actuator, according to an embodiment.
Figure 4:
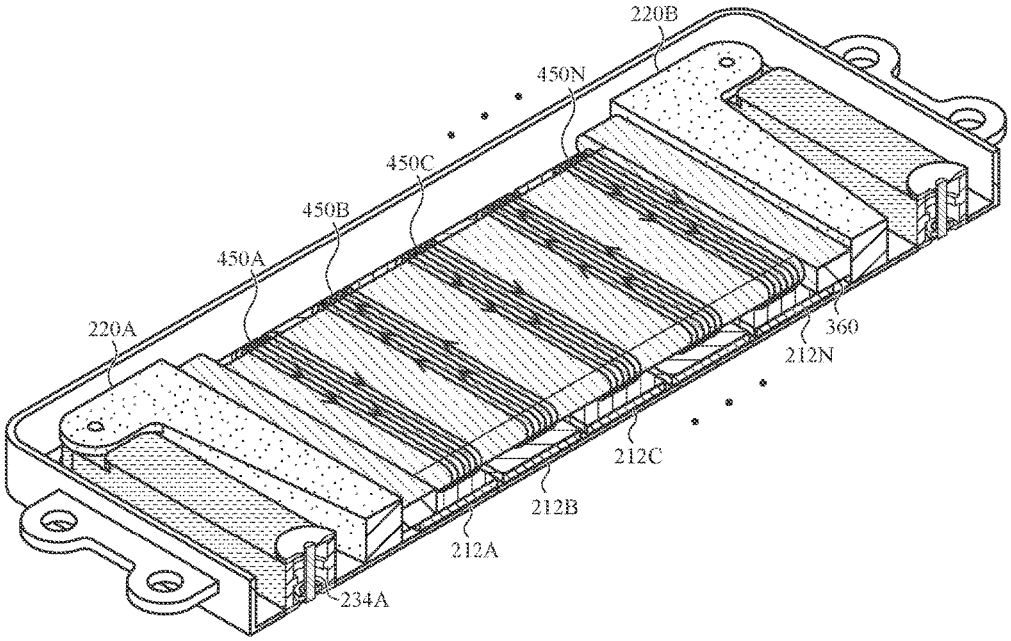
FIG. 4 shows a cross section showing certain internal components of a linear actuator, according to an embodiment.

FIG. 3A illustrates the internal components of the linear actuator within the haptic actuator 200 without showing the housing. In the embodiment shown, the pivots 230A, 230B have respective internal axes 234A, 234B about which the pivot arms 234A, 234B can rotate in both directions. FIG. 3A shows the first and second linear arrays of magnets, 210A-N and 212A-N, configured opposite to each other in parallel planes. A shaft 360 extends between the two parallel planes. A more complete view of the shaft 360 is shown in FIG. 4 and discussed below. The shaft 360, external ends 220A, 220B, pivots 230A, 230B, and pivot arms 234A, 234B form a moveable assembly on which electromagnetic forces induce linear motion, as discussed below.

Embodiments may implement the flexible coupling of pivot arm 232A to external end 220A in a variety of ways to ensure linear, or very nearly linear, motion of the shaft discussed below along the direction of axis 206. In some embodiments the flexible coupling of pivot arms 232A, 232B is configured so that at least the shaft is suspended between the first and second linear array of magnets 210A-N and 212A-N without contacting either array.

In a first embodiment, the pivot arm 232A is flexibly coupled to external end 220A by a pin joint. The external end 220A is rigidly affixed to the shaft 360. As will be discussed below, electromagnetic forces are induced on the shaft 360 between the magnet arrays, with the forces directed along the axis 206. As the shaft 360 moves in response to the forces, the external end 220A exerts a force on the pivot arm 232A at the pin 342A, inducing a torque about the axis 234A of the pivot 230A, inducing the pivot arm to rotate. The rotation of the pivot arm then induces a location of the pin joint 342A to move in along a circular arc. An effect of the such a circular motion of the pin joint is to induce a sideways motion of the external end, and the shaft to which it is rigidly attached, in a direction along the axis 207. However, the amount of such sideways motion can be kept small if: (i) a neutral or equilibrium position of the pivot arm 232A about pivot 230A is along the axis 207, and (ii) rotations from neutral position are through small angles only. The small amount of movement of the external end 220A and shaft 360 along the direction of axis 207 may add to the haptic output produced.

In this embodiment, an analogous configuration for the flexible coupling of pivot arm 232B to external end 220B also is used. In this embodiment, a neutral or equilibrium configuration for both sets of pivot arms 232A, 232B and pivots 230A, 230B is such that the directions from the pin joints 342A, and 342B are toward the respective pivot axes 234A, 234B, i.e., both directions are in the direction of axis 207 of the housing. Thus when the externals ends 220A, 220B and shaft 360 move in the positive direction of long axis 206 of the housing, the rotation of both pivots 230A, 230B is clockwise with respect to the orientation shown in FIG. 3A, with the pivot arms 232A, 232B retaining a mostly parallel orientation. The sideways motion induced in the external ends 220A, 220B, and shaft 360 is then in the positive direction of axis 207 of the housing.

Figure 3B:
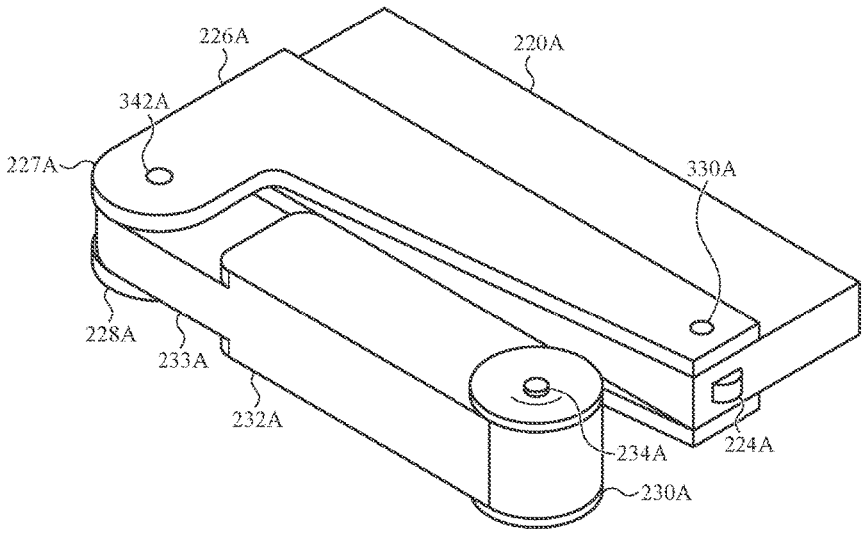
FIG. 3B illustrates details of a first flexible coupling of certain internal components of the embodiment of FIG. 3A.

FIG. 3B shows a second embodiment for an flexible coupling of pivot arm 232A to external end 220A configured to reduce the sideways motion described for the previous embodiments. In this embodiment, the pivot arm 232A is not connected directly to the external end 220, but to a connector 226A. Pivot arm 232A comprises an end section 233A that extends between two extensions, 227A and 228A of the connector 226A. Connector 226A is connected to pivot arm 232A by a pin joint 342A that extends through extension 227A and end section 233A. Connector 226A is then connected to the external end 220A at a second pin joint 330A. The external end 220A is then connected rigidly to the shaft 360. When electromagnetic forces are induced to cause external end 220A and shaft 360 to move along axis 206, the connector 226A may pivot about both pin joints 342A and 330A to allow external end 220A and shaft 360 to move along axis 206 without needing to move along axis 207.

This embodiment may also use an optional slider bearing 224A affixed to the side of external end 220A and positioned to be near, or in contact with, an interior surface of the housing to reduce further sideways motion of the external end 220A and shaft 360 along the axis 207. It would be clear to one of skill in the art that a similar connector (not shown) could be attached on the opposite end of the shaft 360 to connect pivot arm 232B to external end 220B.

Figure 3C:
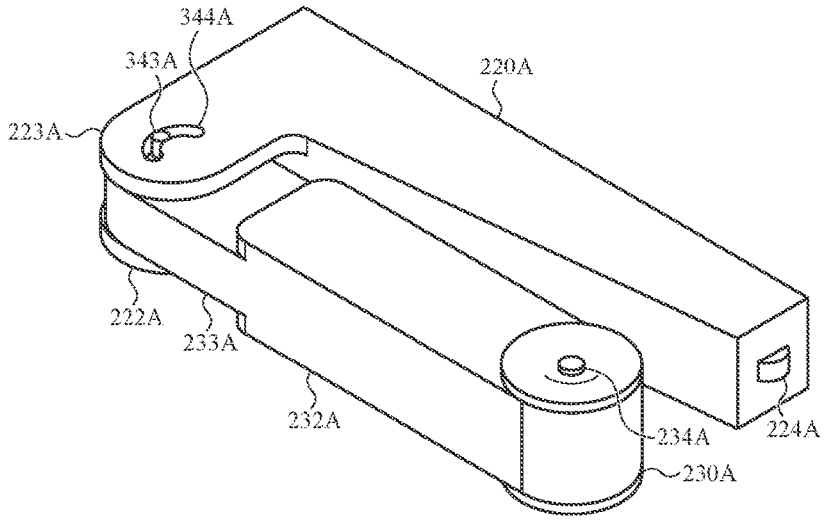
FIG. 3C illustrates details of a second flexible coupling of certain internal components, according to an embodiment.

FIG. 3C illustrates a third embodiment for a flexible coupling of pivot arm 232A to external end 220A that can also reduce the sideways motion for the external end 220A and shaft 360. As in the first described embodiment, the external end 220A is rigidly attached to the shaft 360. The pivot arm 232A includes an end extension 233A that extends between extensions 223A and 222A of external end 220A. But instead of the pin joint 342A shown in FIGS. 3A and 3B, there is a pin 343A extending from the end extension 233A of pivot arm 232A into a circular gap 344A of an extension 223A of the external end 220A. The extension 223A extends about one side of the end section 233A of pivot arm 232A. External end 220A may also comprise a second extension 222A that extends from external end 220A about an opposite side of the end section 233A of pivot arm 232A. The extension 222A may also have a circular gap to receive an opposite end of pin 343A.

When an electromagnetic force is induced on external end 220A and/or shaft 360 causing them to move in the direction of axis 206, a corresponding force is induced on the pin 343A also in the direction of axis 206. The shape of the gap 344A allows the pin 343A to move along a circular arc as pivot arm 232A rotates, while allowing external end 220A and shaft 360 to move along axis 206 without needing to move along axis 207. Optional jewel bearing 224A may be used as described above. A corresponding connection may be used between external end 220B and pivot arm 232B.

Other embodiments may use variations of these connections, or alternative connection configurations, so that linear motion of the shaft from an equilibrium position is opposed by a restoring force. Examples of such alternative connection configurations are discussed below with respect to FIGS. 6A, 6B, and 6C. Alternative connection configurations than those disclosed above, or those discussed below with respect to FIGS. 6A, 6B, and 6C, may also be used in other embodiments.

FIG. 4 shows a cross section of the embodiments shown in FIG. 2A and FIG. 3A, without the top component 203 of the housing and without the first linear array of magnets 210A-N. The shaft 360 is shown extending from external end 220A to external end 220B above the second linear array of magnets 212A-N.

Within pivot 230A is the axis 234A about which pivot 230A rotates. Internal to pivot 230A is a restoring spring, such as a torsion spring, configured to opposes rotation about axis 234A. In one embodiment, a neutral or equilibrium position for the restoring springs of pivots 230A, 230B, and for the moving assembly as a whole, is when the pivot arms 232A is parallel to direction 207 of the housing. The restoring springs may be chosen strong enough to prevent motion of the shaft 360 and its external ends 220A-B from contacting the housing or the pivot arms 232A, 232B, under the maximum electromagnetic force that may be applied to the shaft 360.

In one set of embodiments the shaft 360 may be made of a ferritic material (i.e., one with a high magnetic permeability, e.g., Hiperco 50). Other embodiments may use other ferritic materials.

Along the shaft 360 is a sequence of wire windings forming conducting coils 450A-N around the shaft 360. In the embodiment shown there is one conducting coil for each opposing magnet pair, e.g. coil 450A is between magnets 210A and 212A from the first and second linear arrays of magnets. These conducting coils are positioned along the shaft 360 so as to lie between the faces of the two magnets of each magnet pair. There may be gaps between the conducting coils 450A-N. The planes formed by the first and second linear arrays of magnets are spaced apart sufficiently that the conducting coils do not contact either linear array of magnets.

The conducting coils 450A-N may each have separate connections to an exterior power source. Alternatively, the conducting coils 450A-N may be part of one circuit, with a connection wire linking each conducting coil to the next conducting coil in the sequence of conducting coils. As will be discussed below, in some embodiments the direction of electrical current in the sequence of conducting coils reverses from one conducting coil to its successor in the sequence. For a sequence of conducting coils that are linked as one wire, this current reversal can be implemented by winding the wire in the conducting coils with alternating orientations (e.g., clockwise versus counterclockwise) with respect to the axis of the shaft 360. The connection of the conducting coils to an exterior power source may be through a wire or wires embedded in the shaft 360. Other embodiments may use alternative means of connection to an external source for the current.

The operation of the embodiments of linear actuators shown in FIG. 4 for producing haptic output is more easily understood in conjunction with FIGS. 5A-D.

Figure 5A:
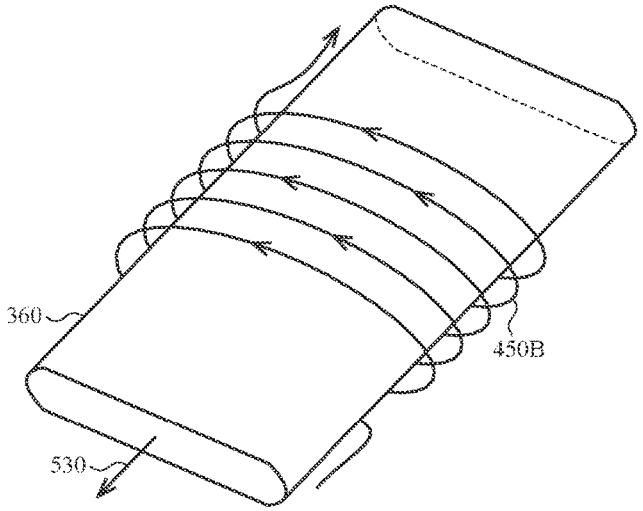
FIG. 5A illustrates details of windings on a ferritic core of a linear actuator, according to an embodiment.

FIG. 5A shows a perspective view of a section of the shaft 360 with the conducting coil 450B that is between the magnets 210B and 212B (not shown). FIG. 5A is a conceptual rendering only, actual details of the cross sectional shape of the shaft 360 and of the configuration of wire windings in the conducting coil may differ. An axis 530 of shaft 360 is shown for orientation and explanatory purposes.

Figure 5B:
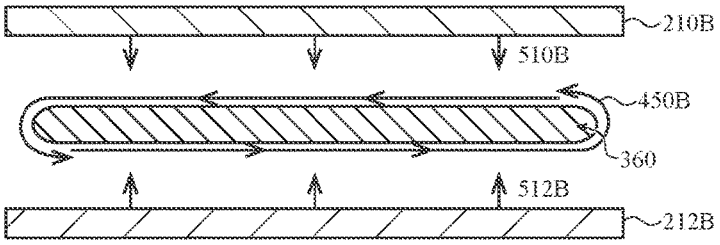
FIG. 5B shows an cross section of the configuration of windings on the ferritic core of the linear actuator of FIG. 5A, according to an embodiment.

FIG. 5B illustrates a cross sectional view across the horizontal axis of the linear actuator at the position of magnet 210B of the first linear array of magnets so that the view is into the axis 530 of the shaft 360. Magnet 210B has a magnetic pole face oriented directly toward the shaft 360, about which are the windings of the conducting coil 450B. On the opposite side of shaft 360 from magnet 210B is magnet 212B, also having a magnetic pole face oriented toward the shaft 360. These two magnetic pole faces both have the same magnetic polarity. The directions of the magnetic fields of magnet 210A and magnet 212B are respectively indicated by the vectors 510B and 512B.

In the embodiment shown, the shaft 360 has a wide, thin planar configuration. As a result, the shown wire windings of conducting coil 450B have wide straight profiles in the shown cross section of FIG. 5B, with two straight lengths on opposite sides of the shaft 360.

Current may be made to flow in the conducting coils 450A-N. If the conducting coils 450A-N are wired together in series, the same current value will flow in each conduction coil. Alternatively, the conducting coils 450A-N may have subsets wired separately to outside power (or voltage or current) sources so that different conducting coils can simultaneously carry different current values. Such variability may be used by the electronic device to control the intensity of the haptic output.

When current flows in a wire that is in a magnetic field B, the flowing charges are subject to the Lorentz force given by the vector cross product $F=qv\times B$, where q is the charge on the particle and v is the velocity of the particle. In the case of current flowing in a wire, the force is felt on the wire.

Figure 5C:
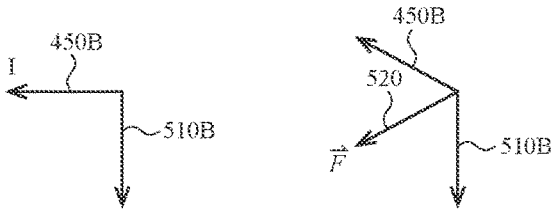
FIG. 5C illustrates vectors of current and forces acting on components of a linear actuator, according to an embodiment.

FIG. 5C shows, for the configuration of FIG. 5B, vectors for the current, I, flowing in the conducting coil 450B, and the magnetic field vector 510B that arises from magnet 210B. In this embodiment the width and flatness of the top wire shown in FIG. 5B, and the width and flatness of the magnet 210B, ensure that v and B are orthogonal so that the cross product is maximized. FIG. 5C also shows a second, slightly rotated view of the vectors for the current in the conducting coil 450B and the magnetic field 510B to show the resulting Lorentz force vector $\vec{F}$ 520 on a wire of the conducting coil 450B.

As the current in conducting coil 450B traverses the bottom straight section below shaft 360, the signs of both by v and B are reversed, where the magnetic field 512B now arises from the opposite magnet 212B of the magnet pair 210B, 212B. Consequently, the resulting Lorentz force on the bottom straight section is aligned (in the same direction) as the Lorentz force on the top straight section.

Because the shaft 360 is made with a ferritic material, the two magnetic fields 510B and 512B are channeled into the shaft 360 and cancel each other therein. Thus the shaft 360 shields the wires in the bottom straight section from the top magnetic field 510B so that magnetic field 510B does not contribute a canceling effect in the calculation of the Lorentz force on the bottom wires in the bottom straight section. Similarly, the shaft 360 shields the wires on the top section of conducting coil 450B from the bottom magnetic field 512B produced by magnet 212B. The result can be a significant total force on the conducting coil 450B, which is imparted to the shaft 360 causing the shaft 360 to move in the direction of its axis 530, which is nearly parallel with the long axis 206 of the housing.

To prevent the shaft from extending so far that it contacts the housing, the springs in pivots 230A-B can be chosen so that their applied restoring force against displacement of the moveable assembly from its equilibrium position at a maximum desired displacement matches the maximum Lorentz force. The Lorentz force depends directly on the induced current so the maximum Lorentz force can be controlled by regulation of the current.

Since haptic output involves a vibratory feel, the motion induced on shaft 360 by the Lorentz force as just described needs to be reversed so that the moveable assembly subsequently moves in the opposite direction. One method for reversing direction of motion of the moveable assembly is to apply an alternating current through the conducting coils. Reversing the direction of the current flow then reverses the sign of the Lorentz force and reverses the direction of motion of the moveable assembly.

Figure 5D:
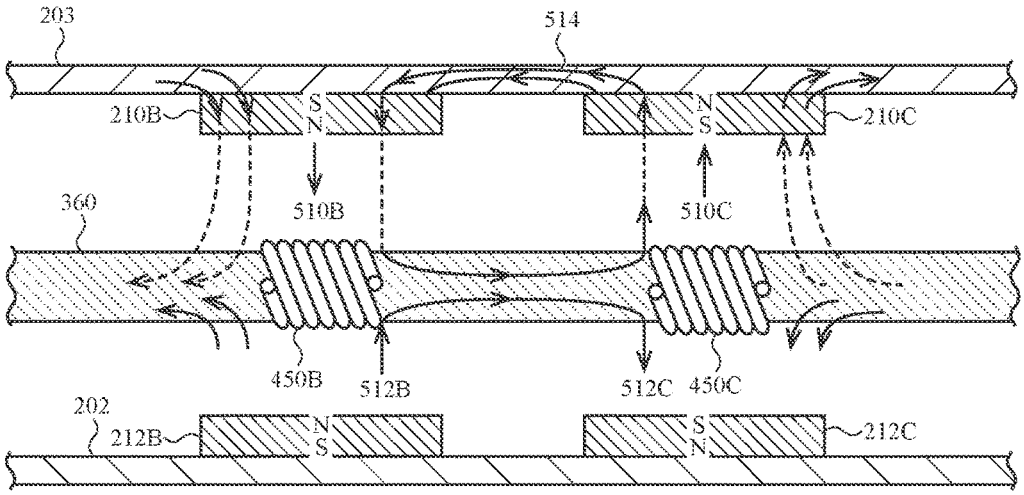
FIG. 5D shows a cross section of components of a linear actuator and directions of magnetic flux, according to an embodiment.

FIG. 5D shows a cross-sectional view along a cut along the long axis 206 of linear actuator as shown in FIG. 2A. The view is thus directly into the width axis 207 of linear actuator as shown in FIG. 2A. Sections of the housing's top component 203 and a bottom surface of the first housing component 202 are shown. Shown attached to the top component 203 are two magnets 210B, 210C from the first linear array of magnets. Shown attached to a bottom section of the first housing component 202 are two magnets 212B and 212C. Also shown is the shaft 360 with two conducting coils.

As discussed previously, the magnets 210B, 210C have magnetic pole faces directed toward respective conducting coils, producing respective magnetic fields 510B and 510C toward or way from the shaft. Since the magnetic polarities of the magnets 210A-N of the first linear array alternate, the magnetic fields 510B and 510C produced by magnets 210B and 210C are reversed. This alternation has a first advantage when the housing is made with a ferritic material. Since each of magnets 210B, 210C has a first of its two magnetic pole faces attached directly to the housing, and since the magnetic polarities of those two first magnetic pole faces are opposite, the ferritic housing creates a magnetic circuit to channel and contain the magnetic flux 514 between those two first magnetic pole faces. Thus the magnetic fields produced by magnets 210B, 210C can have greatly reduced effect outside of the linear actuator.

Since the shaft 360 is also made with a ferritic material, the magnetic fields 510B and 510C from the second magnetic pole faces of magnets 210B-C have reduced divergence (i.e., fringing or flaring field lines) as they emerge. That is, the shaft 360 also provides a partial magnetic circuit that works to maintain the orientation of the magnetic fields 510B and 510C directly toward the shaft 360 (i.e., perpendicularly to the axis 530 of the shaft 360). This helps maximize the Lorentz force across the extent of the conducting coils.

However, as the directions of the magnetic fields 510B and 510C reverse along the first linear array, to have the Lorentz force generated by each conducting coil have the same direction, the directions of the currents in the conducting coils must also reverse from one conducting coil to the next conducting coil. One way this can be achieved is to alternate the orientation of the windings (with respect to the axis of the shaft) of the conducting coils. An alternate way to achieve the reversal of the current direction between conducting coils is reverse how the ends of a following conducting coil are connected to the source that induces the current.

FIG. 5D also shows magnets 212B, 212C from the second linear array of magnets affixed to an interior surface of the first housing component 202 and located on the opposite side of the shaft 360. A similar magnetic circuit is provided by the first housing component 202 to contain the magnetic fluxes from magnets 212B, 212C. Similarly, the shaft 360 provides a magnetic circuit for the fields 512B and 512C from the magnets 212B, 212C. FIG. 5D illustrates how the shaft 360 shields the magnetic fields 512B and 512C from contributing to Lorentz force calculations on the wire components across the top of conducting coil 450B.

The discussion just provided also applies to other conducting coils and magnet pairs in the sequence along the shaft 360. The wire sections across the top and bottom of conducting coil 450C are respectively subjected to Lorentz forces from magnetic fields 510C and 512C from respective magnets 210C and 212C. The current in conducting coil 450C must be reversed in orientation from the current in conducting coil 450B to have the Lorentz force applied on conducting coil 450C be in the same direction as the Lorentz force applied on conducting coil 450B. This can be accomplished by reversing the direction of the windings from one conducting coil to the next (not shown in FIG. 5D) or by reversing the current flow direction between conducting coils 450B and 450C.

When alternating current (AC) is applied to each conducting coil, over a half period of the current the Lorentz force applied to conducting coil 450B will reverse. The form of the applied AC current can be sinusoidal or be the current induced by alternating polarity step voltages. The period of the applied AC current may be selected to limit the total displacement of the moveable assembly, and/or to control the haptic output produced in the electronic device.

An applied AC causes the moveable assembly to oscillate linearly (in both directions) mostly along the axis 206 of the housing. The resulting change in momentum of the moveable assembly is then transferred through the connections of the moveable assembly to the housing to the haptic actuator 200 as a whole. The haptic actuator 200 then transmits the haptic output to the electronic device.

Additional and/or alternative embodiments to those described above are within the scope and spirit of the disclosure, and will now be discussed.

Figure 6A:
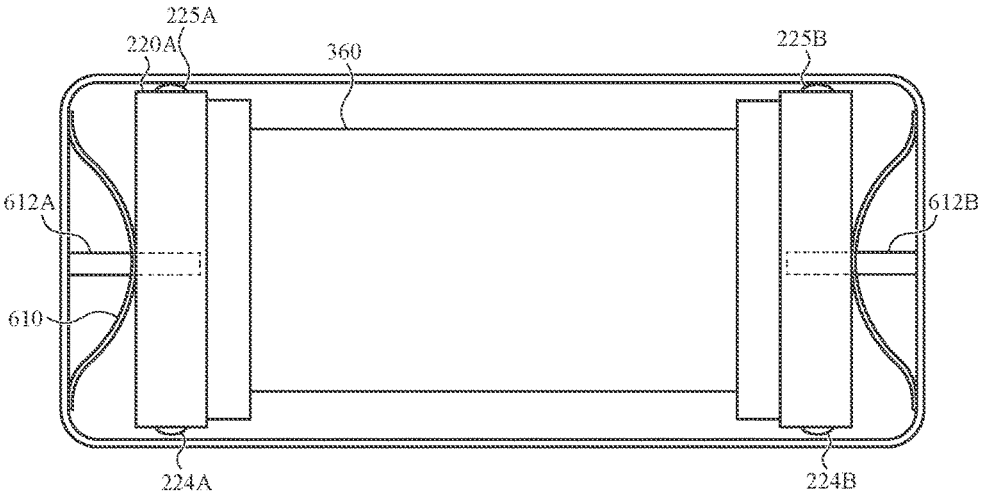
FIG. 6A illustrates a top view of a first alternative mounting of certain internal components of a haptic actuator, according to an embodiment.
Figure 6B:
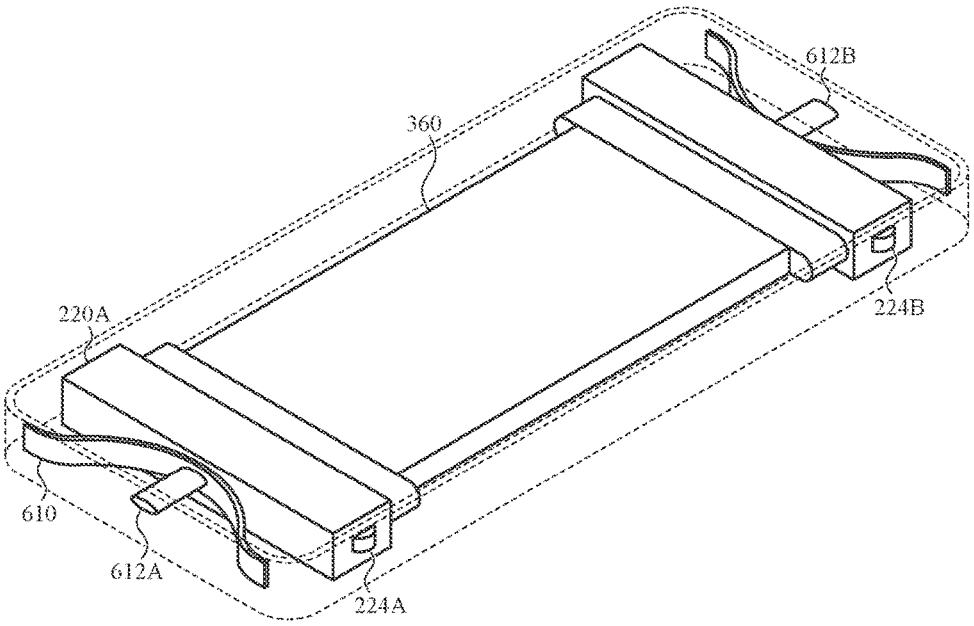
FIG. 6B illustrates a perspective view of the first alternative mounting of certain internal components of the haptic actuator shown in FIG. 6A, according to an embodiment.
Figure 6C:
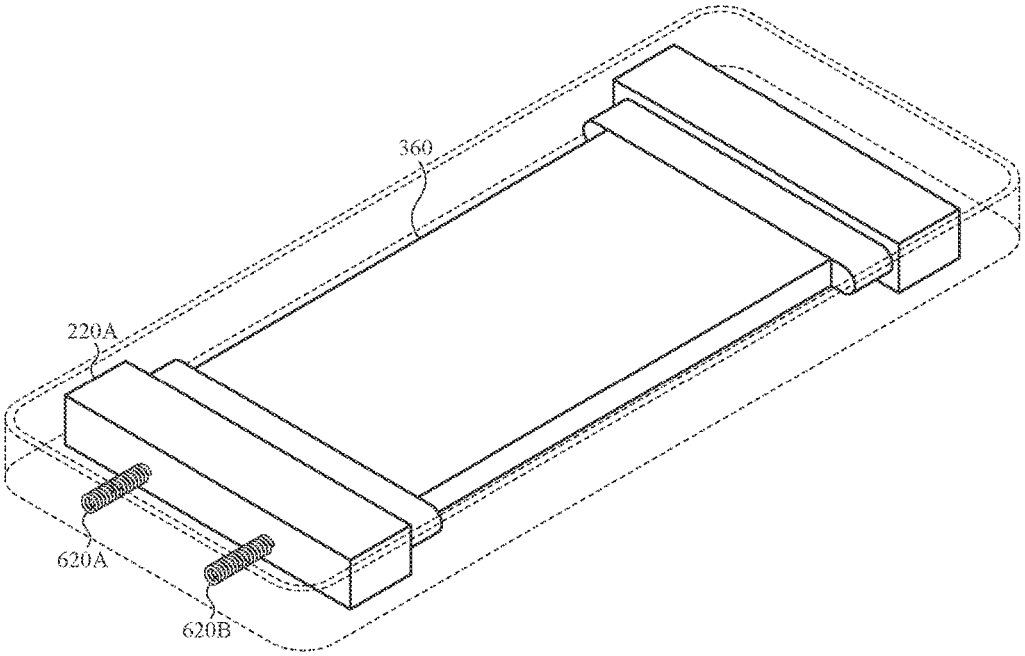
FIG. 6C illustrates a second alternative mounting of certain internal components of a the haptic actuator of FIG. 6A, according to an embodiment.
Figure 6D:
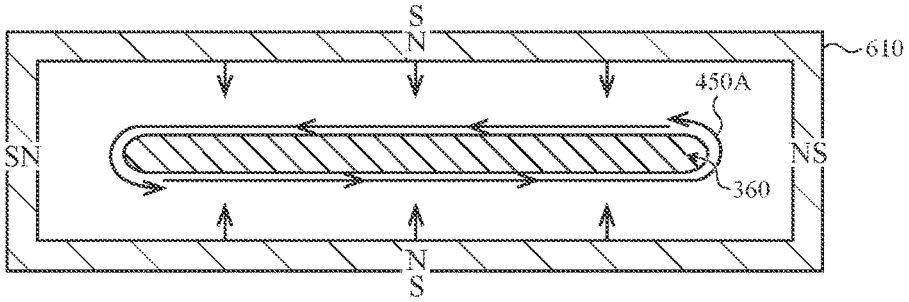
FIG. 6D shows a cross section of an alternative configuration of a shaft and magnet array for a linear actuator of a haptic actuator, according to an embodiment.
Figure 7A:
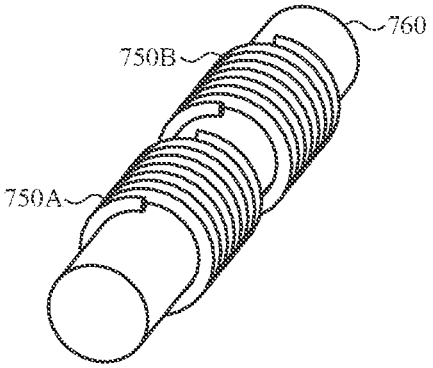
FIG. 7A shows an exploded view of an alternative configuration for a linear actuator having a fixed array of magnets about a moveable shaft with conducting coils, according to an embodiment.
Figure 7B:
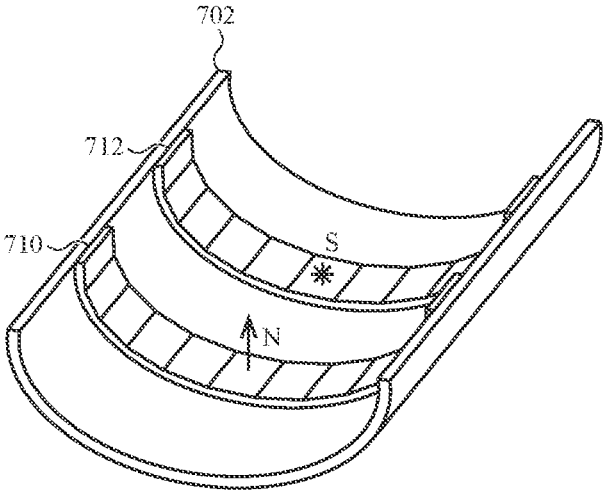
FIG. 7B shows a bottom half of a cylindrical housing composed of a ferritic material.

FIGS. 6A-6C disclose further embodiments that use alternative support mechanisms that suspend the moveable assembly. FIGS. 6A-6C shows embodiments in which the displacement restoring force applied to the moveable assembly is provided by springs rather than by pivots 230A-B and pivot arms 232A-B. FIG. 6D shows embodiments that may use an alternate form of a stationary magnet array about a shaft with conducting coils. FIGS. 7A-B show embodiments that use a cylindrical housing to which is attached a linear array of circular toroidal magnets about a cylindrical shaft.

FIG. 6A shows a top view of an embodiment for a linear actuator for the haptic actuator 200 that uses an alternative set of components for providing a restoring force on the shaft 360. For simplicity of description, the top component 203 of is not shown, nor are the first and second linear arrays of magnets, nor the conducting coils on shaft 360. Instead of the pivots 230A, 232B and pivot arms 232A, 232B described above, leaf springs 610A, 610B are configured on interior surfaces of the first housing component 202 at opposite ends of the long axis 206 of the linear actuator. In order to suspend the shaft 360 between the two linear arrays of magnets, the external ends 220A, 220B may be supported by rods 612A, 612B that are rigidly fixed to interior surfaces of the housing. In another embodiment the support rods 612A, 612B may be one unit extending through the shaft 360. In another embodiment the external ends 220A-B may slide over low friction interior surfaces of the housing. The jewel bearings 224A, 224B, 225A, and 225B may be used to restrict sideways motion of the moveable assembly (now comprising shaft 360 and the external ends 220A, 220B) so that the motion of the moveable assembly is linear along the axis 206.

FIG. 6B shows a perspective view of the embodiment discussed in relation to FIG. 6A. A physical limit to how much the leaf springs 610A-B can deflect can prevent the moving assembly from impacting the housing.

FIG. 6C shows another embodiment of the linear actuator that uses coil springs 620A, 620B configured on at least one interior surface of the first housing component 202. In the embodiment shown, the interior surface is at one end of the long axis 206. The coil springs further contact the external end 220A of the shaft 360 to apply a restoring force to the shaft 360. The coil springs may have rest length chosen as the distance from the external end 220A to the interior when the shaft 360 is in a neutral position.

FIG. 6D illustrates an alternative configuration for a permanent magnet, according to some embodiments. A sequence of toroidal magnets, such as magnet 610, could be used around the shaft 360 in place of a sequence of magnet pairs, such as 210A and 212A, from two opposed linear arrays of magnets. The interior face of toroidal magnet 610 that is directed toward the shaft would be a single magnetic pole face. The exterior face of toroidal magnet 610 would be the opposite magnetic pole face and would be directed into the housing that includes ferritic material to form a magnetic circuit for the flux from the toroidal magnets in the sequence.

FIGS. 7A-B shows an expanded view of an embodiment of a linear actuator that uses an alternative configuration for a linear array of stationary permanent magnets and a movable ferritic shaft containing conducting coils. FIG. 7A shows a cylindrical shaft 760 about which are wound conducting coils 750A and 750B. As described above, the shaft 760 may be made with a ferritic material.

FIG. 7B shows a bottom half of cylindrical housing 702 composed of a ferritic material. It will be clear to one of skill in the art how the symmetrical top half of the cylindrical housing is configured. The ferritic materials of the cylindrical housing 702 and the cylindrical shaft 760 may be the same or different. Shown attached to the interior surface of the cylindrical shaft 702 are permanent magnets 710 and 712. Permanent magnets 710 and 712 may be configured as cylindrical shells, may extend completely around the internal surface of cylindrical housing 702, and be attached to the internal surface of the cylindrical housing 702 along the exterior face of the cylindrical shell. The exterior face of the cylindrical shell magnet 710 may be one magnetic pole face with magnetic field oriented radially into or from the cylindrical housing 702 with respect to the axis of the cylindrical housing 702. The interior faces of the cylindrical shell of permanent magnets 710 and 712 may then be the opposite magnetic pole face so that the emanating magnetic field is directed radially toward the cylindrical shaft 760. The conducting coils 750 and 760 are configured to lie within the cylindrical shells formed by permanent magnets 710 and 712, respectively.

Some embodiments may combine the configurations shown in FIGS. 7A-B with elements described previously to complete a linear actuator for a haptic actuator, as would be clear to one of skill in the art. The operation of such a haptic actuator would be as described previously.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A linear actuator, comprising:

a housing composed of a first ferritic material;

a first set of permanent magnets within, and fixed to, the housing to form a first linear array;

a second set of permanent magnets within, and fixed to, the housing to form a second linear array;

a moveable assembly contained within the housing and comprising:

a shaft comprising a second ferritic material positioned between the first and second sets of permanent magnets; and a set of conducting coils wound around the shaft, a conducting coil of the set of conducting coils being wound around a coil axis and positioned between:

a first permanent magnet, of the first linear array, having a first magnetic axis that extends through and is perpendicular to pole faces of the first permanent magnet, the first magnetic axis being substantially perpendicular to the coil axis; and a second permanent magnet, of the second linear array, having a second magnetic axis that extends through and is perpendicular to pole faces of the second permanent magnet, the second magnetic axis being substantially perpendicular to the coil axis; and a support mechanism within the housing that is attached to the housing and to the moveable assembly, the support mechanism operative to pivot; wherein in response to an electromagnetic force, the moveable assembly moves within the housing while the support mechanism pivots.

2. The linear actuator of claim 1, wherein:

the first and second magnetic axes have a same magnetic polarity; and the coil axis of the conducting coil is parallel to a longitudinal axis of the housing.

3. The linear actuator of claim 1, wherein the second set of permanent magnets has as many permanent magnets as the first set of permanent magnets.

4. The linear actuator of claim 1, wherein the set of conducting coils has as many conducting coils as there are permanent magnets in the first set of permanent magnets.

5. The linear actuator of claim 1, wherein the permanent magnets of the first set of permanent magnets are flat in shape and are positioned along the first linear array so that the first linear array forms a plane.

6. The linear actuator of claim 5, wherein:

the plane is a first plane;

the permanent magnets of the second set of permanent magnets are flat in shape and are positioned along the second linear array so that the second linear array forms a second plane; and the second plane of the second linear array is opposite, and parallel to, the first plane of the first linear array.

7. The linear actuator of claim 6, wherein:

each permanent magnet of the first linear array has a respective magnetic pole face with a magnetic polarity that is oriented perpendicular to the plane of the first linear array;

the magnetic polarities of the respective magnetic pole faces of the permanent magnets of the first linear array alternate along the first linear array;

each permanent magnet of the second linear array has a respective magnetic pole face with a magnetic polarity that is oriented perpendicular to the second plane of the second linear array; and the magnetic polarities of the respective magnetic pole faces of the permanent magnets of the second linear array alternate along the second linear array.

8. The linear actuator of claim 1, wherein the shaft is thinner in cross-section than a permanent magnet of the first linear array.

9. The linear actuator of claim 1, wherein the moveable assembly comprises a first non-ferritic component attached to the shaft at a first end of the shaft, and a second non-ferritic component attached to the shaft at a second end of the shaft.

10. The linear actuator of claim 9, wherein the support mechanism comprises:

a first pivot arm that pivots about a first axis; and a second pivot arm that pivots about a second axis;

wherein the first pivot arm is attached to the first non-ferritic component of the moveable assembly with a first pin joint; and the second pivot arm is attached to the second non-ferritic component of the moveable assembly with a second pin joint.

11. The linear actuator of claim 1, wherein a current flowing in the set of conducting coils generates a Lorentz force that contributes to the electromagnetic force.

12. The linear actuator of claim 1, wherein:

a first current flowing in a first conducting coil of the set of conducting coils generates a first Lorentz force that contributes to the electromagnetic force;

a second current flowing in a second conducting coil of the set of conducting coils generates a second Lorentz force; and the first Lorentz force and the second Lorentz force are aligned.

13. The linear actuator of claim 12, wherein an alternating current is induced in the set of conducting coils so that the electromagnetic force causes the moveable assembly to move alternately in a first direction along a longitudinal axis of the housing and in a second direction opposite to the first direction.

14. A haptic actuator for an electronic device, comprising:

a housing enclosing an interior volume and comprising an exterior attachment component by which the haptic actuator can be attached to the electronic device;

a linear actuator, operative to provide haptic output to the haptic actuator in response to a received input from the electronic device, comprising:

a set of magnets positioned within the interior volume and fixed to one or more interior surfaces of the housing and having magnetic axes that extend through and are perpendicular to pole faces of the set of magnets;

a moveable assembly contained within the interior volume comprising:

a shaft positioned adjacent to the set of magnets; and a set of conducting coils, each respective conducting coil being wound around the shaft and positioned adjacent to a respective magnet of the set of magnets; and a support mechanism within the interior volume that is attached to the housing and to the moveable assembly;

wherein:

each conducting coil is wound around a coil axis that is transverse to the magnetic axes;

the received input from the electronic device causes current to flow in at least one conducting coil;

current flowing in any one of the set of conducting coils generates an electromagnetic force on the shaft directed along an axis of the shaft to cause the moveable assembly to move within the housing as the support mechanism pivots; and the support mechanism applies a restoring force.

15. The haptic actuator of claim 14, wherein:

the set of magnets comprises more than one magnet;

the magnets of the set of magnets are positioned in a sequence with respect to the axis of the shaft; and the polarities of the magnets alternate along the sequence.

16. The haptic actuator of claim 15, wherein the set of conducting coils has as many conducting coils as there are magnets in the set of magnets, and the conducting coils of the set of conducting coils are positioned along the shaft so that each conducting coil is adjacent to one of the magnets of the set of magnets.

17. The haptic of claim 14, wherein the received input from the electronic device causes current to flow in each conducting coil so that the generated electromagnetic forces are parallel.

18. The haptic actuator of claim 16, wherein the set of magnets comprises:

a first subset of permanent magnets that are positioned to form a first linear array; and a second subset of permanent magnets that are positioned to form a second linear array that is opposite to the first linear array;

wherein the shaft is positioned between the first linear array and the second linear array.

19. A system for providing haptic output in an electronic device, the system comprising:

a haptic actuator comprising:

an attachment component connecting the haptic actuator to the electronic device;

a housing enclosing an interior volume; and a linear actuator comprising:

a set of magnets positioned within the interior volume, each respective magnet of the set of magnets having a respective magnetic axis that extends through and is perpendicular to pole faces of the respective magnet;

a moveable assembly contained within the interior volume comprising:

a shaft defining a longitudinal axis that is transverse to the magnetic axes of the magnets of th set of magnets; and a set of conducting coils wound around the shaft, each respective conducting coil at least partially encircling a coil axis substantially coincident with the longitudinal axis of the shaft and positioned adjacent to a respective magnet of the set of magnets; and a support mechanism within the interior volume that is attached to the housing and to the moveable assembly;

wherein:

the electronic device is operative to send a signal to the haptic actuator; and in response to the signal sent from the electronic device being received at the haptic actuator, the haptic actuator is operative to induce a current in the set of conducting coils sufficient to cause the moveable assembly to move linearly.

20. The system of claim 19, wherein the induced current is an alternating current.

* * * * *